US011857090B2

(12) United States Patent
Harris

(10) Patent No.: US 11,857,090 B2
(45) Date of Patent: Jan. 2, 2024

(54) ART RACK WITH DOWELS

(71) Applicant: Darren Alonzo Harris, Sicklerville, NJ (US)

(72) Inventor: Darren Alonzo Harris, Sicklerville, NJ (US)

( * ) Notice: Subject to any disclaimer, the term of this patent is extended or adjusted under 35 U.S.C. 154(b) by 0 days.

(21) Appl. No.: 17/809,302

(22) Filed: Jun. 28, 2022

(65) Prior Publication Data

US 2023/0096008 A1 Mar. 30, 2023

Related U.S. Application Data

(60) Provisional application No. 63/261,849, filed on Sep. 30, 2021.

(51) Int. Cl.
*A47F 7/00* (2006.01)
*A47F 7/14* (2006.01)

(52) U.S. Cl.
CPC ..... *A47F 7/0042* (2013.01); *A47F 7/144* (2013.01)

(58) Field of Classification Search
CPC ..... A47F 7/0042; A47F 7/0014; A47F 7/148; A47F 7/144
USPC ..... 211/41.13, 45
See application file for complete search history.

(56) References Cited

U.S. PATENT DOCUMENTS 238,117 A * 2/1881 Hillman ..... A47F 7/163 211/11
289,825 A * 12/1883 Fulton ..... A47F 7/148 211/50
510,185 A * 12/1893 Mitchell ..... A47L 19/04 211/41.3
1,194,670 A * 8/1916 Schmidt ..... A47L 19/04 211/74
1,246,940 A * 11/1917 Safford ..... A47F 7/0042 211/41.1
1,456,446 A * 5/1923 Hotaling ..... A47F 7/148 211/181.1
1,465,891 A * 8/1923 Breuninger ..... A47F 7/148 211/181.1
2,950,014 A 8/1960 Sullivan
3,666,115 A * 5/1972 Turner ..... A47F 7/0042 211/50
3,777,896 A 12/1973 Ehrlich
3,824,952 A 7/1974 Nagano et al.
4,010,851 A 3/1977 Erikson
4,037,727 A 7/1977 Kunkle
4,127,072 A * 11/1978 LePon ..... A47B 47/04 D6/675.1
4,156,498 A 5/1979 Miller
4,199,171 A 4/1980 Betts
D256,640 S * 9/1980 Farwell ..... D7/701
(Continued)

FOREIGN PATENT DOCUMENTS

WO WO-0010428 A1 * 3/2000 ..... A47F 7/148

*Primary Examiner* — Stanton L Krycinski
(74) *Attorney, Agent, or Firm* — Dunlap Bennett & Ludwig, PLLC

(57) ABSTRACT

An art rack includes a first base rail and a second base rail, each with a plurality of top apertures on their respective top face at least one side aperture on their respective side. The first base rail and the second base are rail joined by at least one base dowel extending from the side apertures. Storage dowels extend from the top apertures, and a space between the storage dowels is operative to accommodating artwork.

8 Claims, 4 Drawing Sheets

(56) References Cited

U.S. PATENT DOCUMENTS

| | | | | | |
|---|---|---|---|---|---|
| 4,245,746 | A | * | 1/1981 | Aylor | A47B 65/15 211/184 |
| 4,368,822 | A | * | 1/1983 | Kramer | B65G 49/067 206/448 |
| D271,453 | S | * | 11/1983 | Tucker | D7/707 |
| 4,538,739 | A | * | 9/1985 | Licari | A47F 7/148 D6/675.5 |
| 4,726,555 | A | | 2/1988 | Andrews | |
| 4,778,064 | A | * | 10/1988 | Gold | B65G 49/062 206/456 |
| 5,020,677 | A | | 6/1991 | Wirth et al. | |
| D346,290 | S | * | 4/1994 | Cifra | D6/675.5 |
| 5,884,778 | A | * | 3/1999 | Freiheit | A47F 7/0042 211/195 |
| D449,414 | S | * | 10/2001 | James | D32/55 |
| 6,669,213 | B2 | * | 12/2003 | Woerner | B62B 3/002 280/47.35 |
| 6,705,233 | B2 | | 3/2004 | Spiewak et al. | |
| 7,143,901 | B1 | * | 12/2006 | Groves | B65D 19/0002 125/35 |
| 7,264,126 | B1 | * | 9/2007 | Bergeron | B65G 49/062 211/41.15 |
| D713,180 | S | * | 9/2014 | Johnston | D6/675.2 |
| D718,557 | S | * | 12/2014 | Johnston | D6/675.5 |
| 9,033,300 | B1 | | 5/2015 | Logan | |
| 9,044,086 | B1 | * | 6/2015 | Johnston | A47B 63/02 |
| 9,044,090 | B2 | | 6/2015 | Drake et al. | |
| 9,955,782 | B2 | * | 5/2018 | Rue | A47B 43/00 |
| 2004/0232025 | A1 | | 11/2004 | Lunde | |
| 2017/0021848 | A1 | | 1/2017 | Linkenhoker | |
| 2017/0209888 | A1 | | 7/2017 | Schaerer | |

* cited by examiner

ART RACK WITH DOWELS

CROSS-REFERENCE TO RELATED APPLICATION

This application claims the benefit of priority of U.S. provisional application No. 63/261,849, filed Sep. 30, 2021, the contents of which are herein incorporated by reference.

BACKGROUND OF THE INVENTION

The present invention relates to art storage and, more particularly, to an art rack with dowels.

Artists, interior decorators, home stagers, homeowners, and others struggle to find a way to store, protect, and organize their canvas and wall art. Typically, canvas and wall art is stored on racks. Racks designed for art storage are extremely limited. They are a pre-set size. Often, that pre-set size is too small, too expensive, and can damage the art. They often do not allow for larger pieces of art and cannot be customized to fit a particular piece of art.

As can be seen, there is a need for customizable, inexpensive, art rack that can accommodate different size art.

SUMMARY OF THE INVENTION

In one aspect of the present invention, an art rack comprises a first base rail with a plurality of top apertures on a top face of the first base rail and at least one side aperture on a side face of the first base rail, a second base rail with a plurality of top apertures on a top face of the second base rail and at least one side aperture on a side face of the second base rail, the first base rail and the second base rail joined by at least one base dowel extending from the at least one side aperture of the first base rail and the at least one side aperture of the second base rail, a plurality of storage dowels extending from the top apertures of the first base rail, and a plurality of storage dowels extending from the top apertures of the second base rail, wherein a space between the storage dowels is operative to accommodating artwork.

These and other features, aspects and advantages of the present invention will become better understood with reference to the following drawings, description, and claims.

DETAILED DESCRIPTION OF THE INVENTION

Figure 1:
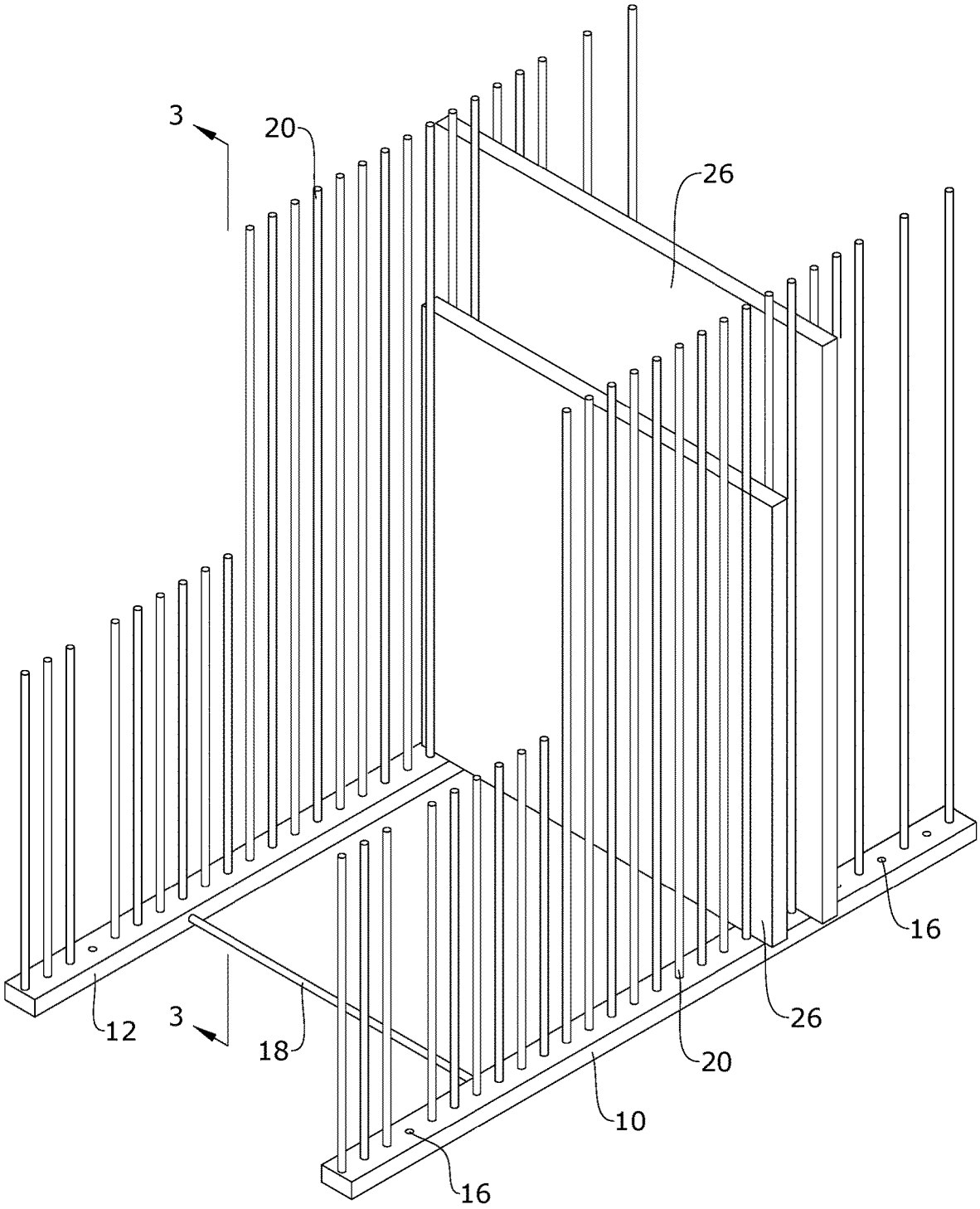
FIG. 1 is a perspective view of an art rack according to an embodiment of the present invention.

The following detailed description is of the best currently contemplated modes of carrying out exemplary embodiments of the invention. The description is not to be taken in a limiting sense but is made merely for the purpose of illustrating the general principles of the invention, since the scope of the invention is best defined by the appended claims with reference to the drawings.

As used herein, directional terms such as upper, lower, upward, downwardly, top, left, right and the like are used in relation to the illustrative embodiments as they are depicted in the figures, such that the upward direction (or upper) being toward the top of the corresponding figures and the downward direction being toward the bottom of the corresponding figures.

A general overview of the various features of the invention will be provided, with a detailed description following. Broadly, an embodiment of the present invention provides an art rack with dowels.

The invention comprises a first base rail and a second base rail placed parallel to each other on a surface such as a floor. The base rails comprise a plurality of top apertures opposite of the surface and a plurality of side apertures on a side of the base rail. An end of a base dowel may be inserted into a side aperture of the first base rail, and an opposite end of the base dowel may be inserted into the side aperture of the second base rail, connecting the base rails. A plurality of base dowels may connect the base rails. The first base rail and the second base rail connected by the base dowel or the plurality of base dowels form a base. A plurality of storage dowels are inserted into the top apertures of the base rails. Slots are formed between the storage dowels for the placement of artwork. The base dowels and the storage dowels may be cylindrical. In some embodiments, the base rails and storage dowels may be slabs of wood, such as standard 2×4s purchased at a hardware store.

Artwork, such as canvas or wall art, may be placed in the slots for storage. The storage dowels enable multiple art works to be stored simultaneously without contacting or pressing on one another. The storage dowels separate, organize, and protect the artwork. Some storage dowels may be removed to form a thicker slot for the placement of thicker artwork. Additional storage dowels may also be inserted to form a thinner slot for the placement of thinner artwork or to form additional slots.

In some embodiments of the present invention, storage dowels may be 24 inches long, but any size dowel may be used to accommodate larger or smaller art works. The storage dowels preferably extend past a height of the artwork. This enables the artwork to fit completely within the slot and prevents damage to a frame of the artwork. The storage dowels may be exchanged with longer or shorter dowels to customize the slot to the height of the artwork. The base dowels may be exchanged for longer or shorter dowels to customize the base to a width of the artwork. The base dowels may be connected to the first base rail and second base rail by fasteners, such as screws.

The base rails may be mounted on a horizontal or vertical surface. This enables artwork to be stored in horizontal or vertical slots.

In some embodiments of the present invention, a second base may comprise base rails with bottom apertures. The second base may be stacked or layered on the storage apertures of a first base via insertion of the storage dowels into the bottom apertures. This enables multiple levels of slots.

The present invention may be disassembled and re-assembled for convenience, transportation, or storage. An adhesive such as glue may join the dowels to the base rails. Screws or nails may also be used.

In some embodiments, the base may also be permanently joined to form a solid piece wherein the base dowels may no longer be disassembled from the base rails.

In some embodiments, the base may be one solid piece. For example, the base may be a plastic, produced by a molding process wherein the base rails and base dowels are all part of the same mold.

The material of the dowels and base rails are not particularly limited by the invention. The dowels and base rails may be wood, metal, plastic such as polyvinyl chloride, or any other suitable material. In some embodiments of the invention, the base dowels may be a block or a plank such as a piece of lumber.

The present invention is not limited to the placement of canvas or wall art. The artwork may include stained glass windows, notebooks, sketchbooks, file folders, papers, cardboard boxes, poster/mat board, portfolios, tables, laptop computers or any other suitable material that may fit in the slots.

Referring now to the Figures, FIG. 1 is a perspective view of art rack according to an embodiment of the present invention. A first base rail 10 is joined to a second base rail 12 by a base dowel 18. Storage dowels 20 protrude vertically from top apertures 16 of the base rails 10, 12. Artwork 26 fits vertically in slots formed by a space between the storage dowels 20. The art rack is customizable as the storage dowels 20 may vary in height, and not all top apertures 16 require a storage dowel 20.

Figure 2:
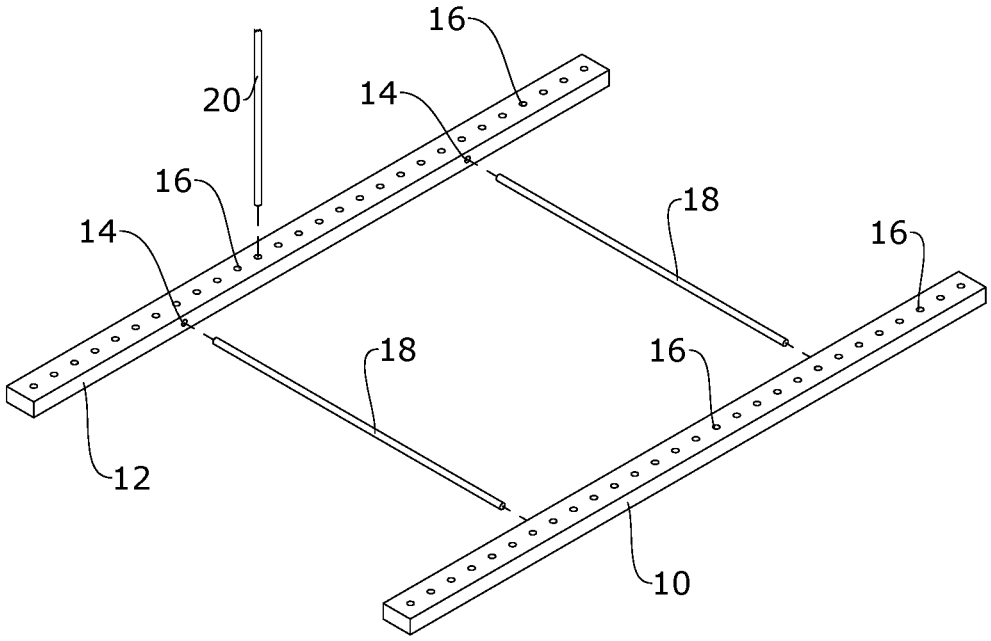
FIG. 2 is an exploded view thereof with one dowel extending therefrom.

FIG. 2 shows an exploded view according to an embodiment of the present invention. The base dowels 18 fit into side apertures 14 on the base rails 10, 12. Top apertures 16 are on a top face of the base rails 10, 12. to accommodate storage dowels 20.

Figure 3:
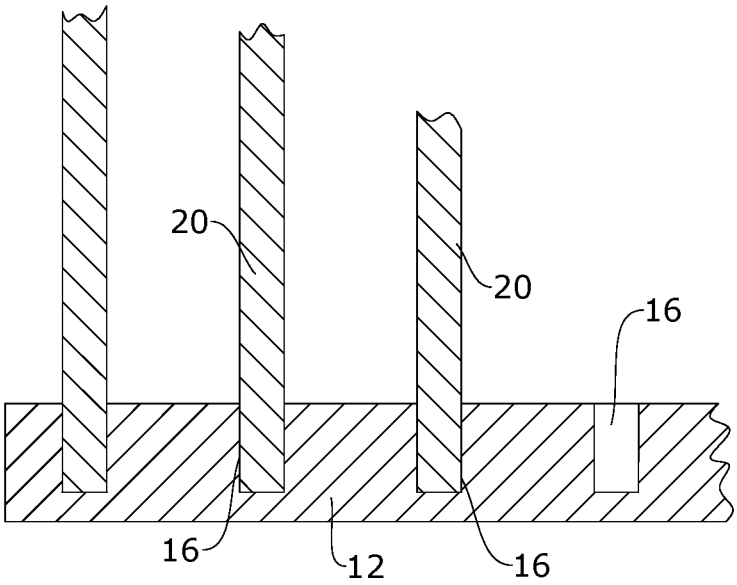
FIG. 3 is a section view taken on the line 3-3 in FIG. 1.

FIG. 3 is a detail view taken on line 3-3 in FIG. 1. Storage dowels 20 fit into top apertures 16 of the second base rail 12.

Figure 4:
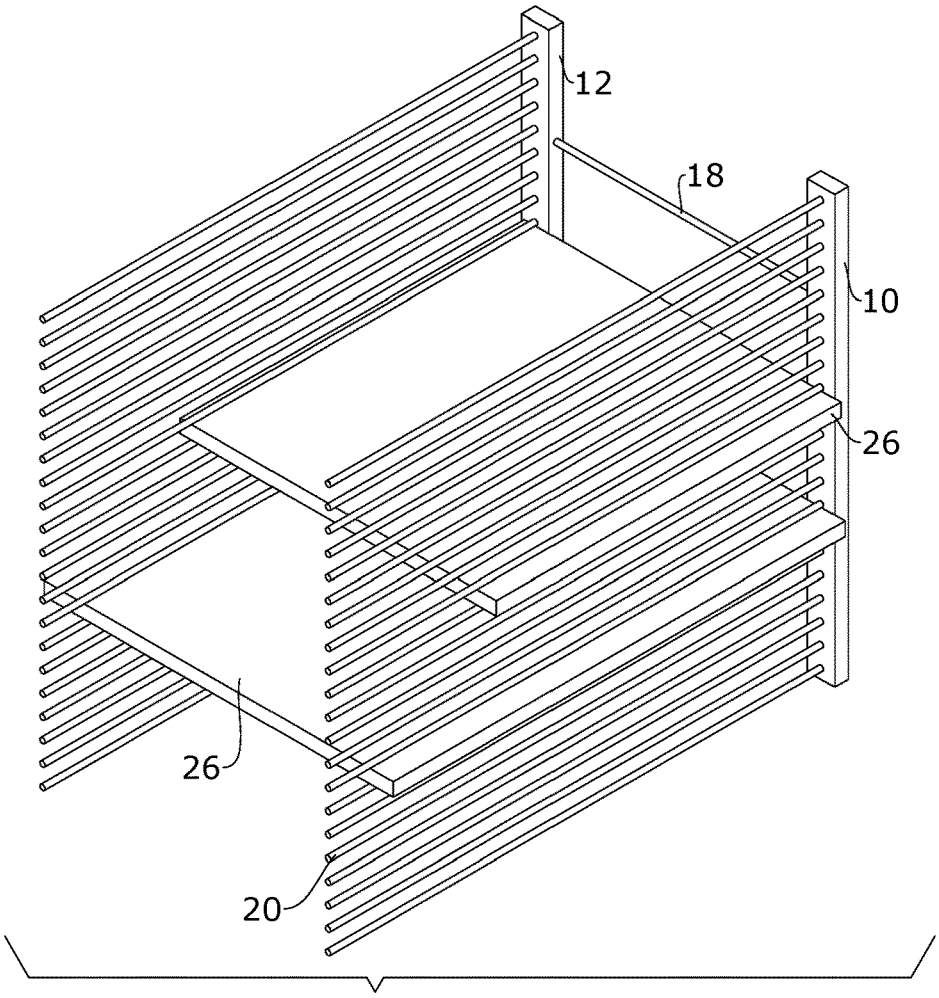
FIG. 4 is a perspective view of an art rack mounted to a wall according to an embodiment of the present invention.

FIG. 4 shows an embodiment of the present invention mounted vertically onto a wall. The artwork 26 then fits into the slots horizontally.

Figure 5:
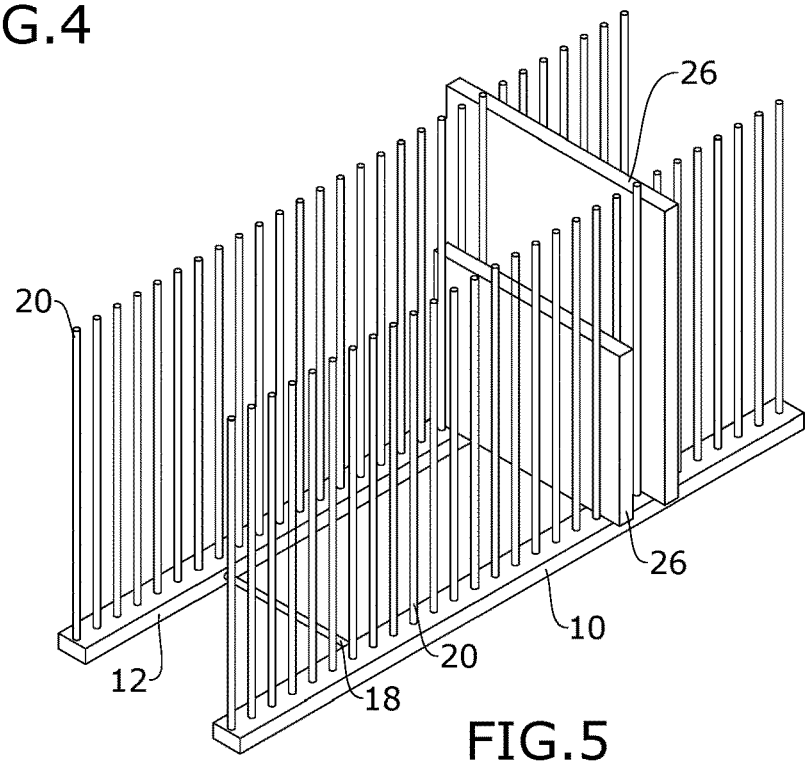
FIG. 5 is a perspective view of a long art rack according to an embodiment of the present invention.

FIG. 5 shows an embodiment of the present invention with base rails 10, 12 having a greater length. Accordingly, the embodiment has more storage dowels 20 and more slots for storing artwork 26.

Figure 6:
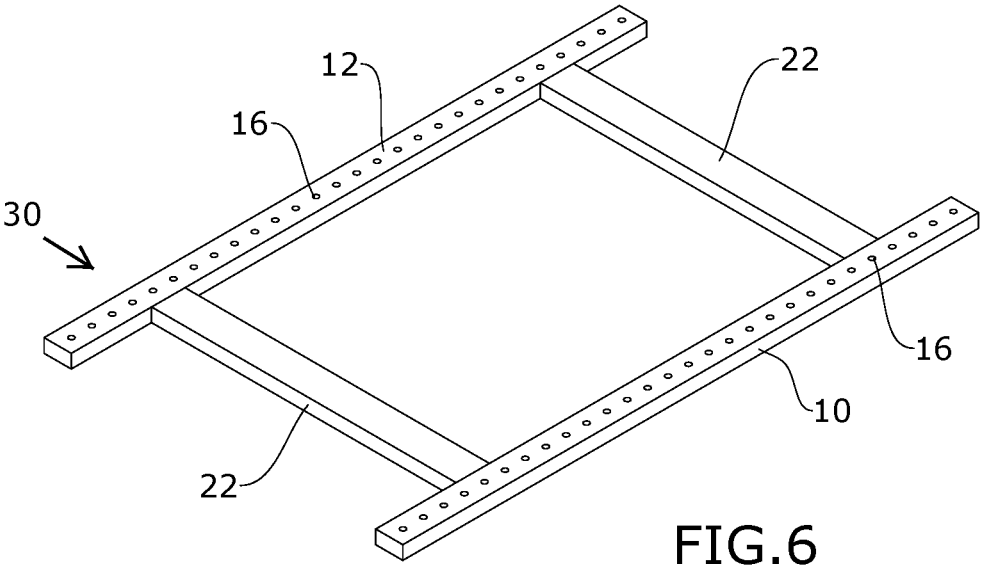
FIG. 6 is perspective view of an alternate embodiment of an art rack with alternate base dowels, according to an embodiment of the present invention.

FIG. 6 depicts an alternate embodiment of a base 30 with an alternate embodiment of base dowels 22. The alternate embodiment of base dowels 22 are rectangular cuboids or blocks, providing a more secure and stable base. The alternate embodiment of the base dowels 22 may be joined to the first base rail 10 and the second base rail 12 by fasteners or by fitting into the side aperture 14.

Figure 7:
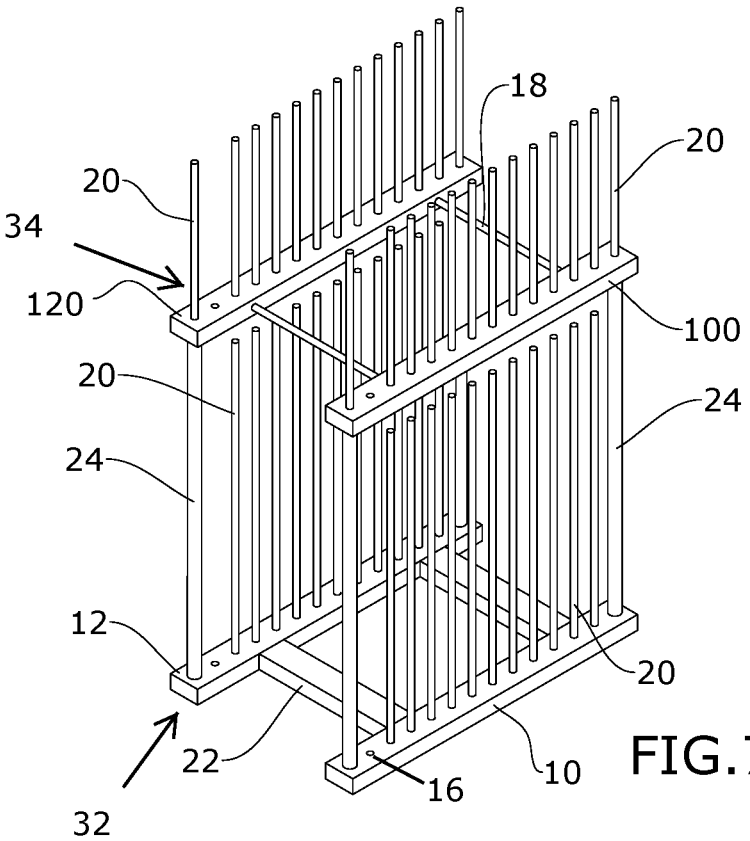
FIG. 7 is a perspective view of a multi-layer art rack according to an embodiment of the present invention.

FIG. 7 shows multi-layer art rack according to an embodiment of the present invention. Connector dowels 24 extend from top apertures 16 of a first base rail 10 and second base rail 12. The first base rail 10 and second base rail 12 form a bottom base 32. The connector dowels 24 secure the bottom base 32 to a top base 34, forming a multi-layer art rack. The top base comprises a third base rail 100 and a fourth base rail 120. The connector dowels 24 may be secured to the top base by means of a bottom aperture (not pictured) or by means of a fastener or adhesive. The connector dowels 24 may be thicker than storage dowels 20. The thickness of the connector dowels 24 may vary. The top base 34 and bottom base 32 may each be utilized for storing artwork 26.

It should be understood, of course, that the foregoing relates to exemplary embodiments of the invention and that modifications may be made without departing from the spirit and scope of the invention as set forth in the following claims.

What is claimed is:

1. An art rack comprising:

a first base rail with a plurality of top apertures on a top face of the first base rail and at least one side aperture on a side face of the first base rail;

a second base rail with a plurality of top apertures on a top face of the second base rail and at least one side aperture on a side face of the second base rail;

the first base rail and the second base rail joined by at least one base dowel extending from the at least one side aperture of the first base rail and the at least one side aperture of the second base rail;

a plurality of storage dowels extending from the top apertures of the first and second base rails, wherein the plurality of storage dowels comprises a plurality of long storage dowels and a plurality of short storage dowels, and wherein each long storage dowel has a long length that is longer than a short length of each short storage dowel, and wherein a space between the storage dowels is operative to accommodating artwork; and a plurality of connector dowels extending from the top apertures of the first base rail and top apertures of the second base rail, joining the first base rail to a third base rail and joining the second base rail to a fourth base rail, wherein a thickness of each connector dowel is thicker than a thickness of each storage dowel, wherein the third base rail and fourth base rail are joined by base dowels and a plurality of storage dowels extend from top apertures of the third base rail and the fourth base rail.

2. The art rack of claim 1, wherein the first base rail and the second base rail are parallel to each other, and wherein each long storage dowel in its top aperture of the first rail has a complementary long storage dowel parallel to it in the second rail, whereby the artwork accommodated by said parallel long storage dowels has an artwork height less than the long length.

3. The art rack of claim 1, wherein the first base rail and the second base rail are horizontally placed on a surface.

4. The art rack of claim 1, wherein the first base rail and the second base rail are vertically mounted to a wall.

5. The art rack of claim 1, wherein the storage dowels are cylindrical.

6. The art rack of claim 1, wherein the at least one base dowel is cylindrical.

7. The art rack of claim 1, wherein the at least one base dowel is a rectangular cuboid.

8. A multi-layer art rack kit comprising:

a base layer sub-kit comprising:

a first base rail with a plurality of top apertures on a top face of the first base rail and at least one side aperture on a side face of the first base rail;

a second base rail with a plurality of top apertures on a top face of the second base rail and at least one side aperture on a side face of the second base rail;

the first base rail and the second base rail joined by at least one base dowel extending from the at least one side aperture of the first base rail and the at least one side aperture of the second base rail;

a plurality of storage dowels extending from the top apertures of the first base rail, wherein the plurality of storage dowels comprises a plurality of first storage dowels and a plurality of second storage dowels, and wherein each first storage dowel has a first length that is smaller that of a second length of each second storage dowel; and a plurality of storage dowels extending from the top apertures of the second base rail;

wherein a space between the storage dowels is operative to accommodating artwork; and an upper layer sub-kit comprising:

a plurality of connector dowels for extending from the top apertures of the first base rail and top apertures of the second base rail, joining the first base rail to a third base rail and joining the second base rail to a fourth base rail, wherein the third base rail and fourth base rail are joined by base dowels and a plurality of upper storage dowels extend from top apertures of the third base rail and the fourth base rail, wherein each upper storage dowel has a length smaller than the first length.

* * * * *